United States Patent [19]

Farman

[11] 4,154,482

[45] May 15, 1979

[54] MINERAL MINING MACHINES

[75] Inventor: Richard E. Farman, Burton-on-Trent, England

[73] Assignee: Coal Industry (Patents) Limited, England

[21] Appl. No.: 848,034

[22] Filed: Nov. 3, 1977

[30] Foreign Application Priority Data

Nov. 16, 1976 [GB] United Kingdom ..... 47646/76

[51] Int. Cl.[2] ..... E21C 35/22

[52] U.S. Cl. ..... 299/81

[58] Field of Search ..... 299/1, 81

[56] References Cited

U.S. PATENT DOCUMENTS

| | | | |
|---|---|---|---|
| 3,102,718 | 9/1963 | Eberle | 299/1 |
| 3,591,235 | 7/1971 | Addison | 299/1 |
| 3,954,302 | 5/1976 | Browning | 299/81 |

*Primary Examiner*—Ernest R. Purser

*Attorney, Agent, or Firm*—Stevens, Davis, Miller & Mosher

[57] ABSTRACT

A mineral mining machine of the shearer type has a hollow drive shaft for the cutter drum. Mounted coaxially within the shaft is a tube which has affixed to both ends electrical plugs which are releasably attachable to complementary sockets disposed at the ends of the shaft. An electrical conduit carrying conductors extends coaxially within the tube and is electrically connected at each end to the plugs. This arrangement allows electrical control signals to be fed through the conduit between the face side of the machine and the goaf side thereof, the arrangement being easily disengageable from the shaft. At the same time, a dust suppressant can flow through the tube and around the conduit between an input manifold and a discharge manifold which distributes the suppressant to cutting tools on the drum.

8 Claims, 1 Drawing Figure

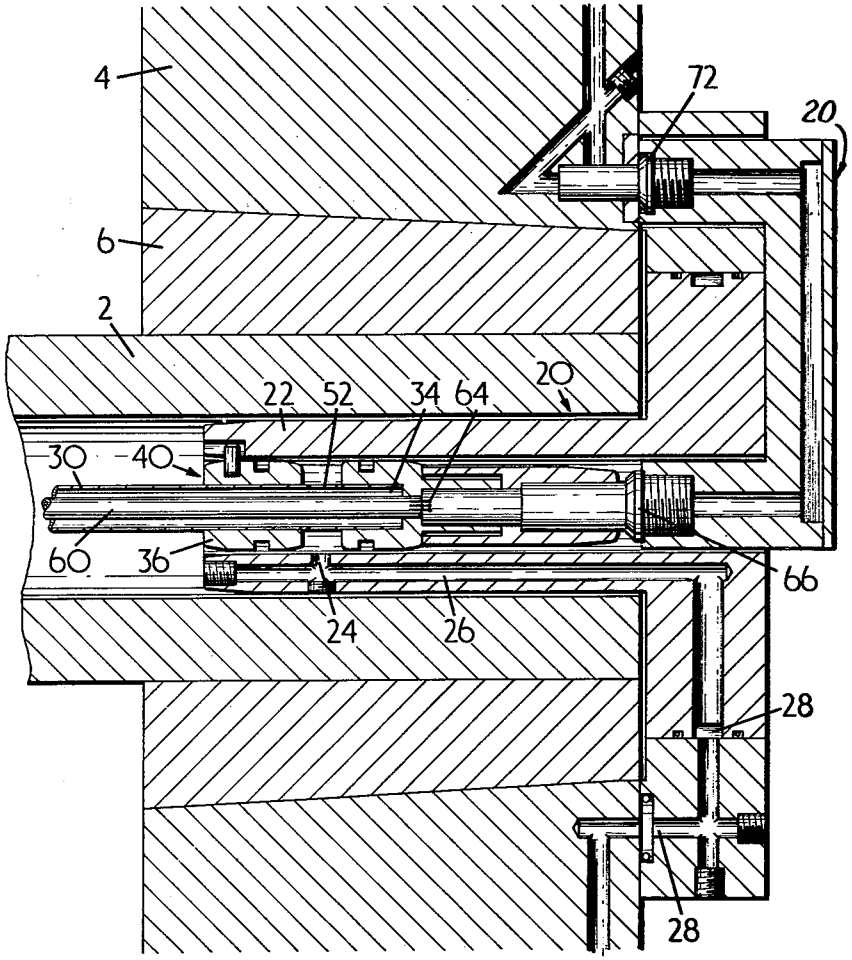
20
72
66
28
28
20
64
34
52
22
26
24
40
36
30
60
4
6
2
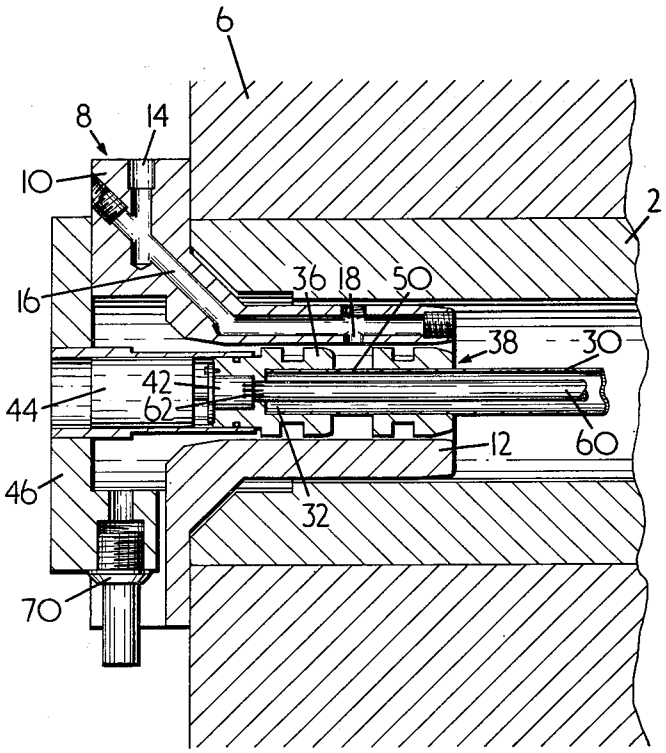
2
30
60
38
12
50
18
36
32
6
14
8
10
16
42
62
44
46
70

MINERAL MINING MACHINES

This invention concerns improvements in or relating to mineral mining machines.

The present invention has particular reference to such machines of a type (hereinafter referred to as the type described) including a body which is adapted for reciprocal movement along a mineral face, and a cutter drum rotatably mounted on a horizontal or substantially horizontal axis which in use extends substantially perpendicular to the face such that upon rotation of the drum and translational movement of the machine body mineral is won from the face. In some embodiments of this type of machine the cutter drum is mounted on a fixed part of the machine body and in others it is mounted on a ranging arm such that the drum may be afforded a cutting sweep in use between the roof and the floor of the mineral seam. In both these embodiments, it is desirable for the machine to be steered so as to ensure that the cutter drum does not penetrate the overlying or underlying strata of the seam, e.g. coal, and thereby win a waste material, for example shale. In order to assist in the steering of the machine, various proposals have been put forward for sensing some condition obtaining or encountered during the traverse of the machine along the face, which condition may form the basis of a desired cutting datum or horizon to be followed by the cutter drum of the machine. For example, it has been proposed to employ a nucleonic sensor mounted adjacent and to the rear of the cutter drum in the direction of machine travel; the sensor emits electromagnetic radiation towards the newly cut horizon and receives an amount of back scattered radiation indicative of the thickness of a coal layer which is generally left adjacent a mineral boundary of the seam. By comparing this amount with a predetermined level indicative of a desired thickness of the coal layer, the machine may be steered to follow the desired cutting path. While this proposal has been successful on the machine of the type described where the cutter drum is mounted on a fixed part of the machine, it has proved difficult to provide a satisfactory control facility on a machine on which the cutter drum is mounted on a ranging arm, the difficulty lying in correlating the sensing data and the relative positions of the ranging arm, and therefore the cutter drum, and the machine body both of which affect the cutting horizon profile.

An alternative proposal involves the sensing of a physical characteristic of the mineral being cut and using this to vary the position of the cutter drum to effect the desired cutting horizon. In the assignee's U.K. Patent 1,141,191 such a proposal is disclosed whereby the variation in force on a cutter tool caused by the difference in hardness as between the mineral seam being cut and the mineral bounding the seam is measured by strain gauge means to produce a signal indicative of the orientation of the mining machine. This proposal has proved successful as an aid to machine steering. However, one of the difficulties attendant upon the use of this technique is that of feeding the signal from the cutter tool on the drum, which is rotating in use, to a control facility on the machine. It is common for the drum to be mounted on a hollow shaft and to provide appropriate electrical wiring within the cavity; however, the difficulty arises in providing a connection between those wires and the strain gauge means on the face side of the drum, and between the wires and a static junction on the goaf side of the machine. Slip rings have been used both for the connection and the static junction, but these have proved unreliable for the connection and are liable to contamination by mineral particles which tend to penetrate the chamber provided for the slip rings. Furthermore, if any maintenance is required, it is only with difficulty that any repair or work can be effected and this generally only when the machine has been removed from its working position, sometimes to the workshop. This necessarily results in lost production time.

It is also the general practice, at least in the United Kingdom, to provide means for suppressing dust generated during operation of the cutter drum and to this end a dust suppression fluid, usually water, is fed to the cutter tools mounted on the peripheral wall or vanes of the cutter drum. The water feed may be led along the cavity of the cutter drum shaft and thus when electrical wires are also provided therealong, additional difficulties arise in arranging both the electrical and water supplies within the shaft.

An object of the invention is therefore to provide an improved mineral mining machine of the type described which will assist in reducing the difficulties associated with the known arrangements.

Accordingly the invention provides a mineral mining machine of the type described including a hollow rotatable shaft on which the cutter drum is fixedly mounted, an elongate tubular member extending longitudinally within the shaft and having an inlet and an outlet end, fluid input and discharge manifolds associated with the ends of the hollow shaft and communicating with the inlet and outlet ends respectively of the tubular member, and an electrical conduit arranged within the tubular member and electrically connected at each end thereof to a terminal plug member, each plug member being releasably engageable with a complementary socket located at or towards the end of the hollow rotatable shaft and being held therewithin for rotation therewith. Conveniently the tubular member is attached to the terminal plug members, the casings of which may advantageously be so formed as to provide a flow path for a fluid between the inlet and outlet ends of the tubular member and the input and discharge manifolds respectively. At the outlet end of the tubular member which is situated at the face side end of the hollow rotatable shaft, the terminal plug member preferably fits inside a cylindrical portion of the discharge manifold, the cylindrical portion extending coaxially within the hollow shaft. A mechanical connection may advantageously be provided between the cylindrical portion of the discharge manifold, which is adapted in use for fixture to the cutter drum, and the terminal plug member. In the absence of a mechanical connection, frictional contact between the portion and the plug member will effect a sufficient drive engagement to afford the member rotational movement with the hollow shaft.

The inlet manifold is preferably non-rotational and has a bore within which the terminal plug member is rotatably mounted, the socket being rotatable therewith and being electrically connected to a slip ring assembly at the goaf side of the hollow shaft.

By way of example only, one form of mineral mining machine of the type described and according to the invention is described below with reference to the accompanying drawing which is a longitudinal sectional view through the rotatable shaft of such a machine.

Referring to the drawing, a mineral mining machine includes a body (not shown) and a hollow rotatable shaft 2 extending horizontally from the body and having mounted thereon a cutter drum 4 the boss 6 of which drivably engages the shaft 2. A fluid input manifold 8 fixed in relation to the shaft 2 has a flange 10 and a cylindrical section 12 extending therefrom into the shaft 2. The flange 10 has an inlet 14 leading to a passageway 16 which extends into the section 12 terminating in an outlet 18. A fluid discharge manifold 20 is located at the opposite end of the shaft 2 on the face side thereof and is fixed to the drum 4. The manifold 20 has a cylindrical part 22 with a fluid inlet 24 leading to a passage 26 and outlets 28, the part 22 locating coaxially within the hollow shaft 2.

A tubular member 30 extends longitudinally of and coaxially within the shaft 2 and has inlet and outlet ends 32, 34 respectively, which are connected to casings 36 of terminal plug members 38, 40. The plug member 38 is releasably engageable with a socket 42 which is rotatable therewith and is connected to a slip ring arrangement shown generally at 44 which is held in an end cap 46 attached to the input manifold 8. The casing 36 is relieved in the vicinity of the outlet 18 of manifold 8 to communicate with an inlet aperture 50 into the tubular member 30. At the outlet end of the tubular member 30, an outlet 52 is provided and communicates with the inlet 24 in the discharge manifold. The tubular member 30 is secured in fluid tight manner in the casings 36 of both plug members 38, 40.

An electrical conduit 60 is located coaxially within the tubular member 30 and is electrically connected to the plug members 38, 40 as indicated schematically at 63,64 respectively. The plug member 40 is releasably engageable with a socket 66 secured to the discharge manifold 20 at the face side end of the shaft 2, the member 40 being engaged on its outer surface within the cylindrical part 22 of the manifold 20, so as to be rotatable therewith.

In practice, electrical wiring (not shown) is provided to the cap 46 via a connector 70 and to the slip ring arrangement 44, from where electrical signals are transmitted either to or from the socket 42 and plug member 38. Electrical wires (not shown) extend along the electrical conduit 60 to the plug member 40 which through engagement with the socket 66 connect with a plug 72 in the manifold 20. A plurality of cutter tools (not shown) is provided on the drum 4, and at least one of the tools is provided with a force sensing element (not shown) which is adapted to derive an electrical signal indicative of the force on the cutter tool, the signal in use being fed along the conduit 60 to the face side of the machine whence it is transmitted to a control circuit (not shown) of the machine.

At the same time that electrical signals are fed along the shaft 2, a dust suppression fluid, e.g. water is fed into the inlet 14 of manifold 8 and passageway 16 thereof to issue through outlet 18 into the tubular member 30 via the inlet aperture 50. The water then flows along the member 30 towards the outlet end 34 thereof around the electrical conduit 60 and discharges through the outlet 52 and inlet 24 of the manifold 20. The water then passes through the passage 26 to the outlets 28 which are advantageously connected to pipe work (not shown) for distribution to nozzles (not shown) on the drum 4.

If any electrical fault should develop, then the removal of the electrical components within the shaft 2 is a relatively easy matter. The cap 46 is released from the inlet manifold 8 and by pulling on the cap the socket 42 is released from the plug member 38. By applying a force on the end of the plug member 38 to extract it, the plug member 38, tubular member 30, conduit 60 and plug member 40 are released as a unitary assembly from connection to socket 66. If necessary a replacement assembly of plug members 38, 40, member 30 and conduit 60 can be provided and inserted in the shaft 2 and the reverse procedure to that just described effected.

It can be seen therefore that the present invention provides a simple and yet efficient means of supplying both dust suppression fluid and electrical wiring through a hollow shaft of a mining machine of the type described, the advantage lying in the ease of disconnection and extraction of the component parts for the fluid and electrical arrangements.

I claim:

1. A mineral mining machine including a body which is adapted for reciprocal movement along a mineral face, and a cutter drum rotatably mounted on a substantially horizontal axis which, in use, extends substantially perpendicular to the face such that upon rotation and translational movement of the machine body mineral is won from the face wherein the improvement comprises the cutter drum being fixedly mounted on a hollow rotatable shaft, and a removable elongate tubular member extending longitudinally within the shaft and having an inlet end and an outlet end, fluid input and discharge manifolds associated with ends of the shaft and communicating with the inlet and outlet ends respectively of the tubular member, an electrical conduit arranged within the tubular member and connected thereto, terminal plug members electrically connected to each end of the conduit, and complementary socket means with which the terminal plug members are releasably engageable, each socket means being located adjacent an end of the hollow shaft and being rotatable therewith.

2. A mineral mining machine according to claim 1 in which the tubular member is attached to the terminal plug members.

3. A mineral mining machine according to claim 1 in which each terminal plug member includes a casing, and a fluid flow path is formed in each casing for a fluid flow between the inlet and outlet ends of the tubular member and the input and discharge manifolds respectively.

4. A mineral mining machine according to claim 1 in which the discharge manifold has a cylindrical portion extending coaxially within the hollow shaft.

5. A mineral mining machine according to claim 4 in which the terminal plug member at the outlet end of the tubular member fits inside the cylindrical portion of the discharge manifold.

6. A mineral mining machine according to claim 5 in which the terminal plug member is mechanically connected to the cylindrical portion of the discharge manifold.

7. A mineral mining machine according to claim 1 in which the input manifold is non-rotational and has a cylindrical section defining a bore within which the terminal plug member at the inlet end of the tubular member is rotatably mounted.

8. A mineral mining machine according to claim 7 in which the socket is rotatable with the terminal plug member, and a slip ring assembly is adapted for electrical connection to the terminal plug member.

* * * * *